US010024180B2

(12) United States Patent
Hicks et al.

(10) Patent No.: US 10,024,180 B2
(45) Date of Patent: Jul. 17, 2018

(54) TRANSITION DUCT ARRANGEMENT IN A GAS TURBINE ENGINE

(71) Applicant: Siemens Energy, Inc., Orlando, FL (US)

(72) Inventors: Paul G. Hicks, Jupiter, FL (US); William W. Pankey, Palm Beach Gardens, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 427 days.

(21) Appl. No.: 14/549,044

(22) Filed: Nov. 20, 2014

(65) Prior Publication Data

US 2016/0146026 A1 May 26, 2016

(51) Int. Cl.
*F02C 1/00* (2006.01)
*F01D 9/02* (2006.01)

(52) U.S. Cl.
CPC ..... *F01D 9/023* (2013.01)

(58) Field of Classification Search
CPC ..... F01D 9/023; F01D 9/02; F23R 3/46
See application file for complete search history.

(56) References Cited

U.S. PATENT DOCUMENTS 2,608,057 A * 8/1952 Boyd ..... F01D 9/023 60/39.37
2,748,567 A * 6/1956 Dougherty ..... F01D 9/023 60/39.37
3,741,678 A * 6/1973 Arlington ..... F01D 9/023 415/117
4,016,718 A * 4/1977 Lauck ..... F01D 9/023 60/39.37
5,392,596 A * 2/1995 Holsapple ..... F01D 9/023 431/353
5,709,076 A * 1/1998 Lawlor ..... F02C 3/165 416/22
5,953,919 A * 9/1999 Meylan ..... F01D 9/044 60/752
7,930,891 B1 * 4/2011 Brostmeyer ..... F01D 9/023 415/209.2
2010/0037618 A1 * 2/2010 Charron ..... F01D 9/023 60/752
2010/0077719 A1 * 4/2010 Wilson ..... F23R 3/425 60/39.37
2010/0115953 A1 * 5/2010 Davis, Jr. ..... F01D 9/023 60/737
2011/0020118 A1 * 1/2011 Smoke ..... F01D 9/02 415/191
2013/0269821 A1 * 10/2013 DiCintio ..... F01D 9/023 138/177

(Continued)

*Primary Examiner* — Gerald L Sung

(57) ABSTRACT

An arrangement for a gas turbine engine includes a combustor for producing a working medium by combustion of a mixture of fuel and an oxidant, a turbine section comprising a stationary vane carrier on which a first row of stationary vanes is arranged, and a transition duct for leading the working medium from the combustor to the turbine section. The transition duct has a forward end that adjoins the combustor and an aft end that adjoins the stationary vane carrier. The transition duct has a transition duct axis extending from the forward end to the aft end along a straight line. The transition duct axis is normal to a vane axis of a stationary vane in the first row of stationary vanes.

11 Claims, 3 Drawing Sheets

(56) References Cited

U.S. PATENT DOCUMENTS

| | | | | |
|---|---|---|---|---|
| 2013/0330180 | A1* | 12/2013 | Guendogdu | F01D 5/145<br>415/182.1 |
| 2014/0127008 | A1* | 5/2014 | Davi | F02C 7/00<br>415/183 |

* cited by examiner

TRANSITION DUCT ARRANGEMENT IN A GAS TURBINE ENGINE

BACKGROUND

1. Field

Embodiments of the present invention relate generally to gas turbine engines, and in particular, to a transition duct arrangement in a gas turbine engine and method installation thereof.

2. Description of the Related Art

A conventional gas turbine engine includes a compressor section, a combustion section including a plurality of combustors, and a turbine section. Ambient air is compressed in the compressor section and conveyed to the combustors in the combustion section. The combustors combine the compressed air with a fuel and ignite the mixture creating combustion products defining hot working gases that flow in a turbulent manner and at a high velocity. The working gases are routed to the turbine section via a plurality of transition ducts. Within the turbine section are rows of stationary vane assemblies and rotating blade assemblies. The rotating blade assemblies are coupled to a turbine rotor. As the working gases expand through the turbine section, the working gases cause the blades assemblies, and therefore the turbine rotor, to rotate. The turbine rotor may be linked to an electric generator, wherein the rotation of the turbine rotor can be used to produce electricity in the generator. The transition ducts are positioned adjacent to the combustors and route the working gases from the combustors into the turbine section through turbine inlet structure associated with a first row stationary vane assembly.

In engines with can combustors, such as in non-aero-derivative industrial gas turbine engines, the combustor is mounted at an angle to the main engine axis. Often this angle is selected based on previous design efforts which have an emphasis on easy-access to the fuel nozzles and combustion can for overhaul purposes. As a result, the transition duct not only has to transition the hot gas flow from the circular can combustor to a curved rectilinear inlet leading to the stationary vanes, but must also turn the flow from the axis of the combustor to the axis of the engine. This "bent-and-squished-tube" geometry results in localized hot spots leading to circumferential non-uniformity along the transition duct.

In order to maintain the metal temperature of the transition duct at a level below the oxidation limits of the bond coat, additional cooling air may be placed at the hotspot locations, typically leading to uneven heating of the transition duct and an increase in thermal stresses. Furthermore, the shape of the transition duct requires both axial and radial manipulation during the last few inches of assembly to align the transition duct with the first row of stationary vanes and to engage the transition mouth seals.

In one known technique, a non-uniform pattern of convective cooling channels, running from the inner diameter to the outer diameter of the transition duct, are placed on the upper and lower panels of the transition duct. Localized cooling is added where needed by using effusion cooling, typically near the side walls upstream of the exit face and under the aft support of the transition duct. The flow-path within the transition duct is coated with TBC (thermal barrier coating) to insulate the metal from the hot gas. The transition duct typically has a shorter service life than the turbine components do to the life limitations of the TBC.

SUMMARY

Briefly, aspects of the present invention provide a transition duct arrangement in a gas turbine engine and method installation thereof.

In a first aspect, an arrangement for a gas turbine engine is provided. The arrangement comprises a combustor for producing a working medium by combustion of a mixture of fuel and an oxidant, a turbine section comprising a stationary vane carrier on which a first row of stationary vanes is arranged, and a transition duct for leading the working medium from the combustor to the turbine section. The transition duct has a forward end that adjoins the combustor and an aft end that adjoins the stationary vane carrier. The transition duct has a transition duct axis extending from the forward end to the aft end along a straight line. The transition duct axis is normal to a vane axis of a stationary vane in the first row of stationary vanes.

In a second aspect, a transition duct is provided for a gas turbine engine. The transition duct comprises a transition duct axis, and a conduit for conducting a working medium along the transition duct axis. The transition duct axis extends along a straight line from a forward end to an aft end of the transition duct.

In a third aspect, a method for installing a transition duct in a gas turbine engine is provided. The method includes positioning the transition duct between a combustor and a turbine section of the gas turbine engine. The positioning is carried out such that a forward end of the transition duct adjoins the combustor while an aft end of the transition duct adjoins a stationary vane carrier on which are arranged a first row of stationary vanes of the turbine section. The transition duct has a transition duct axis extending from the forward end to the aft end along a straight line. In the installed state, the transition duct axis is normal to a vane axis of a stationary vane in the first row of stationary vanes.

BRIEF DESCRIPTION OF THE DRAWINGS

The invention is shown in more detail by help of figures. The figures show preferred configurations and do not limit the scope of the invention.

DETAILED DESCRIPTION

Figure 1:
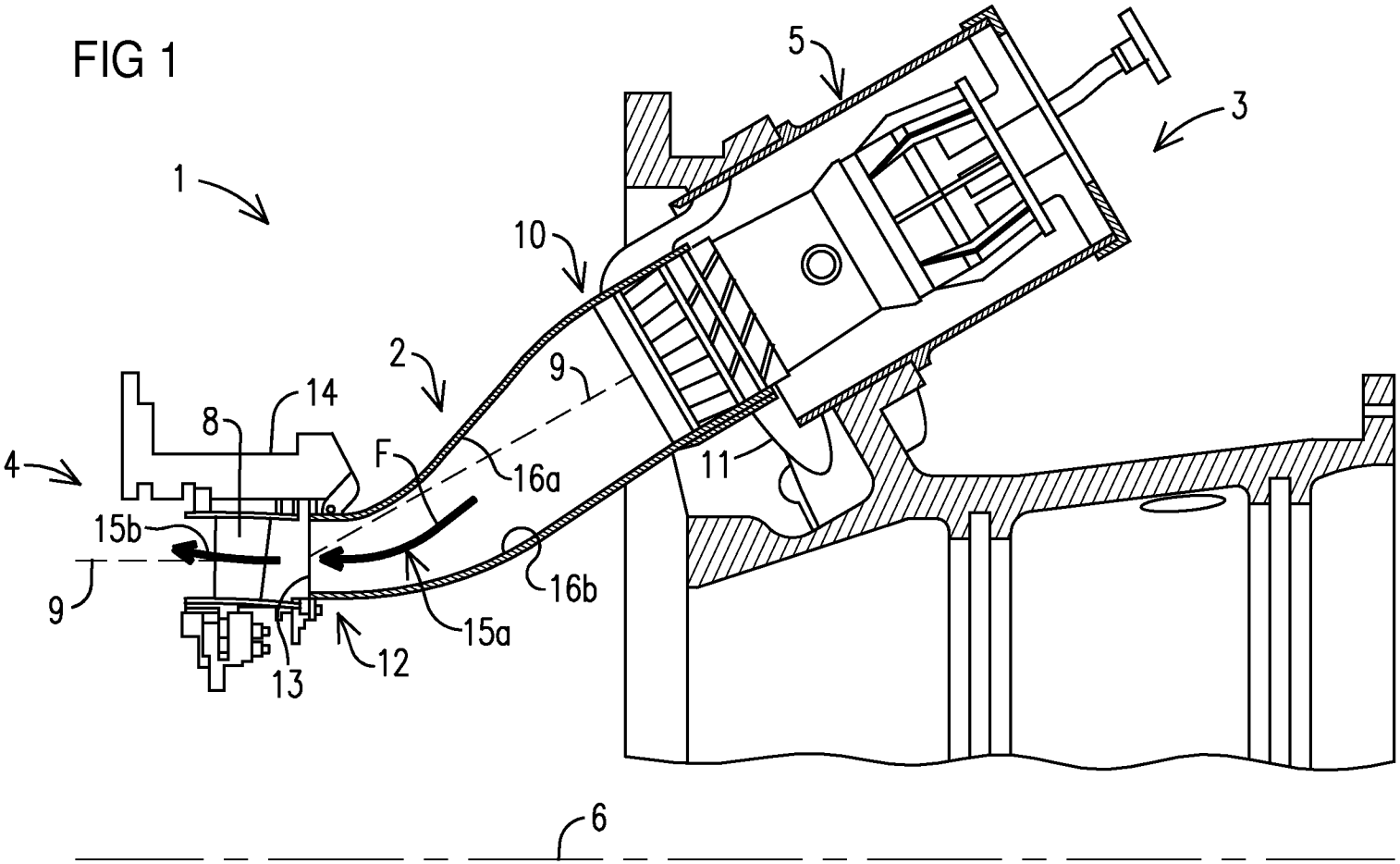
FIG. 1 illustrates a side elevation view of a portion of a known gas turbine engine including a transition duct extending from a combustor to a first row of stationary vanes.

Embodiments of the present invention illustrated herein provide a transition duct arrangement in a gas turbine engine and an associated method for installing a transition duct in a gas turbine engine. The illustrated embodiments may provide improvements to existing transition duct arrangements, for example, by way of reducing thermal burden in the transition duct with reduced impingement of the hot combustion gas in the transition duct wall.

As used in this Specification, the terms "forward" and "aft" are defined in relation to the direction of flow of the working medium, wherein forward refers to a relative upstream position and aft refers to a relative downstream position. The flow direction is indicated by the reference sign F in the drawings.

Referring to FIG. 1, a portion of a known type of gas turbine engine 1 is illustrated, including a transition duct 2 extending from a combustor section 3 to the entrance of a turbine section 4. The combustor section 3 may include, for example, a can-annular arrangement including plurality of combustors 5 arranged in a circular arrangement about a turbine axis 6, which is also the engine axis. Only one such combustor 5 is shown in FIG. 1. Each combustor 5 comprises a combustion zone wherein a combustion gas is produced by combustion of a mixture of fuel and an oxidant, such as compressed air from a compressor section (not shown) of the gas turbine engine 1. The combustion gas forms a working medium which is expanded in the turbine section 4 to extract mechanical energy.

Each combustor 5 has a respective transition duct 2 attached thereto that provides a conduit for conveying the working medium comprising the hot combustion gas from the combustor 5 to the entrance of the turbine section 4, where the combustion gas is directed toward a first row of stationary vanes 8 arranged on an annular shaped stationary vane carrier 14, also referred to turbine vane carrier or TVC. An inlet end or forward end 10 of the transition duct 2 adjoins the combustor 5, and may be supported thereto, for example, by a forward mount 11. An outlet end or aft end 12 of the transition duct adjoins a stator component of the gas turbine engine, such as the stationary vane carrier 14. A transition aft frame 13 may be provided at the aft end 12 of the transition 2 that directly engages with the stationary vane carrier 14. The transition duct 2 in this example has a geometric profile that transitions from a generally circular cross-section at the forward end 10, substantially corresponding to the shape of the outlet from the combustor 5, to a generally trapezoidal or rectangular arc-like cross-section at the aft end 12 adjoining the stationary vane carrier 14, while also defining a radially inwardly extending path for the gas flow. The cross-section of the conduit at the aft end 12 may be referred to as curved rectilinear.

The transition duct 2 has a transition duct axis 9 along which the working medium (i.e., the hot combustion gas) is conducted from the forward end 10 to the aft end 12 leading up to the first row of stationary vanes 8. In the example of FIG. 1, the transition duct axis 9 transitions from a radially inward direction inclined at an angle to the engine axis 6 to an axial direction parallel to the engine axis 6. The angle of inclination may be determined, for example, based on convenience of access to the fuel nozzles and combustion cans for overhaul purposes. For example, the inclination angle may range from 30-45°, but may assume other values.

As can been seen, in the example of FIG. 1, the transition duct 2 not only has to transition the hot gas flow from the forward end 10 adjoining the circular can combustor 5 to a curved rectilinear aft end 12 leading to the stationary vanes 8, but must also turn the flow from the axis of the combustor 5 to the axis 6 of the gas turbine engine. As shown, the flow is turned at 15*a* from an angled direction to an axial direction (i.e., along engine axis 6). The flow is further turned at 15*b* from an axial direction (along the engine axis 6) to a tangential direction by the first row of stationary vanes 8.

The above described flow path requires a "bent-and-squished-tube" geometry results in localized hot spots leading to circumferential non-uniformity along the transition duct. The hotspots are caused by impingement of the hot combustion gas on the metallic inner wall 2*a* of the transition duct. Example locations where such impingement takes place are shown by reference signs 16*a* and 16*b*. In order to maintain the metal temperature of the transition duct wall 2*a* at a level below the oxidation limits of the bond coat, additional cooling air may be placed at the hotspot or impingement locations 15*a-b*, which may lead to uneven heating of the transition duct 2 and an increase in thermal stresses. Furthermore, the shape of the transition duct 2 requires both axial and radial manipulation during the last few inches of assembly to align the transition duct 2 with the first row of stationary vanes 8 and to engage the transition mouth seals.

Figure 2:
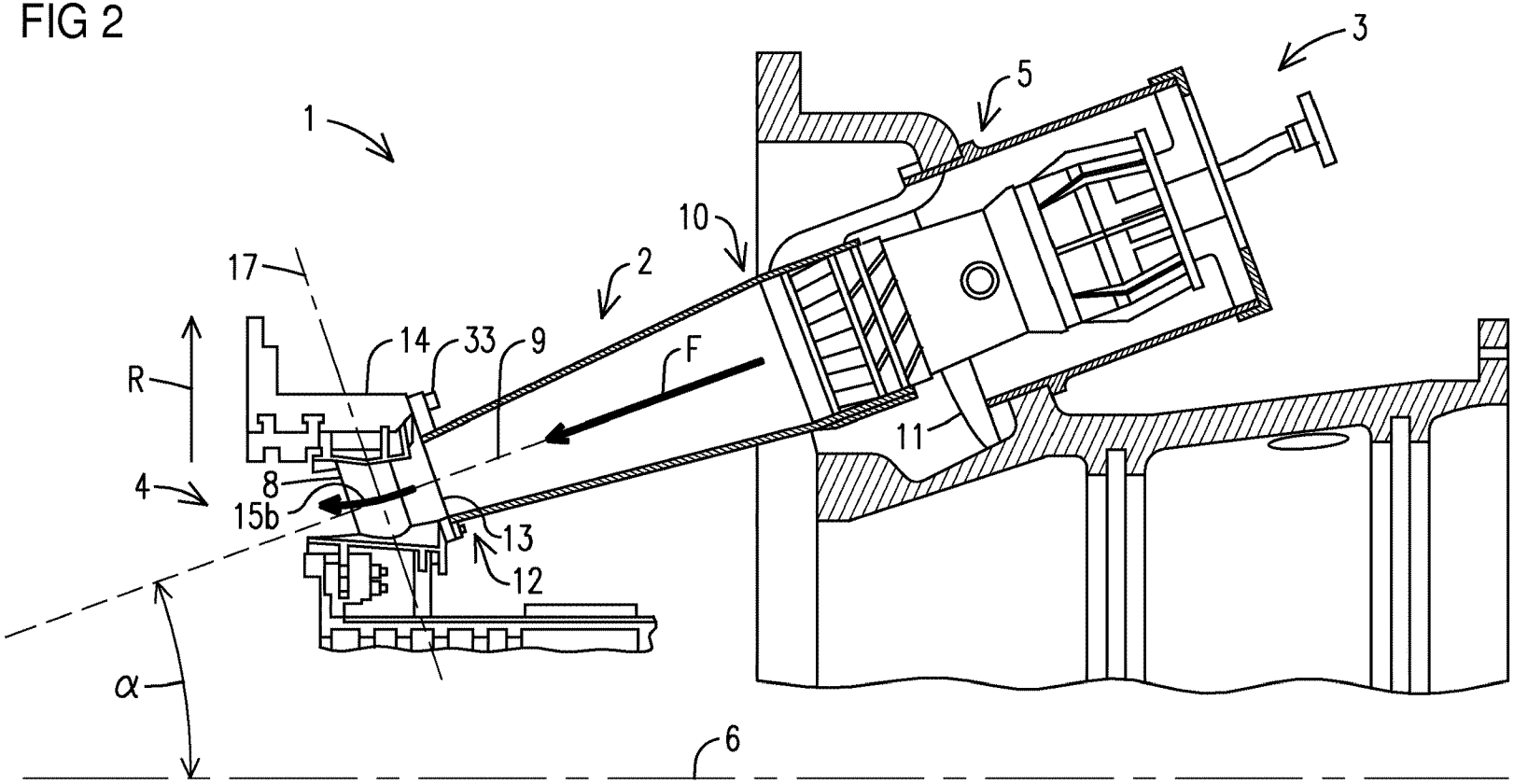
FIG. 2 illustrates a side elevation view of a portion of an inventive gas turbine engine including a transition duct arranged in accordance with one embodiment of the present invention.

FIG. 2 illustrates a side elevation view of a portion of an inventive gas turbine engine including a transition duct arranged in accordance with one embodiment of the present invention. Herein, like elements are designated by like reference signs as used in FIG. 1. In the embodiment of FIG. 2, the transition duct 2 is contoured such that the transition duct axis 9 is a straight line with no turns or transitions. In other words, the transition duct axis 9 extends from the forward end 10 of the transition duct 2 adjoining the combustor 5 to the aft end 12 of the transition duct 2 adjoining the stationary vane carrier 14 all along a single straight line with no turns. The cross-section of the conduit defined by the transition duct 2 may transition from a circular cross-section at the forward end 10 to a curved rectilinear cross-section at the aft end 12.

As a consequence of the distinctive differences in contouring, the angled to axial flow turn indicated as 15*a* in FIG. 1 may be avoided in the embodiment of FIG. 2. However, the turning of the flow from an axial to a tangential trajectory still occurs at the first row of stationary vanes 8, as indicated by 15*b*. To this end, the vane form of each stationary vane 8 is configured such that a vane axis 17 of the vane 8 is normal to the transition duct axis 9.

Under normal design, for example as in the embodiment of FIG. 1, the vane axis 17 of a stationary vane 8 in the turbine section extends in a radial direction, while the transition duct axis 9 is aligned parallel to the engine axis 6 at or near the aft end 12. In the embodiment of FIG. 2, the transition duct axis 9 is a straight line without any turn, inclined at a non-zero angle $\alpha$ with respect to the engine axis 6. This means that the flow of the combustion gas would reach the first row of stationary vanes 8 not axially as in FIG. 1, but along the inclined direction, since there is no inclined-to-axial turn of the flow in the transition duct 2.

In the illustrated embodiment, the first row of stationary vanes 8 is structurally designed, such that the vane axis 17 of each vane 8 is not along a radial direction R, but is correspondingly inclined at an angle $\beta$ to the radial direction R, such that the vane axis 17 is normal to the flow along the inclined transition duct axis 9.

Figure 3:
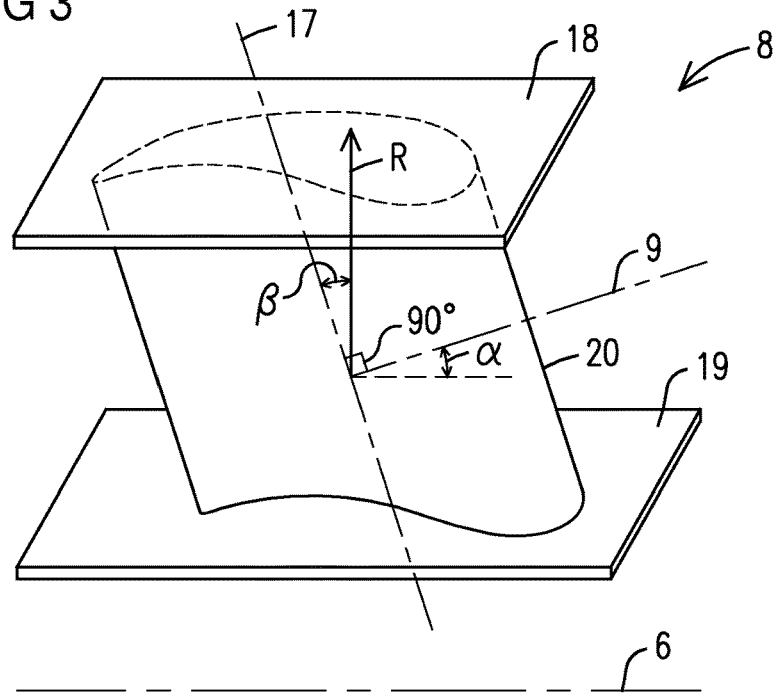
FIG. 3 is a schematic illustration of the design of a stationary first row vane according one embodiment.

FIG. 3 is a schematic illustration of an arrangement of a first row stationary vane 8 in accordance with the presently described embodiment. The stationary vane 8 includes a vane root 18, a cover plate 19, and an airfoil 20 extending between the vane root and the cover plate along the axis 17 which is referred to as the vane axis. The vane root 18 may be attached to the stationary vane carrier 14. The radial direction is indicated as R. In this case, the vane 8 is so designed that the axis 17 makes an angle $\beta$ with respect to the radial direction R. The angle $\beta$ may be determined as a function of the angle $\alpha$ that the transition duct axis 9 makes with the engine axis 6, such that the vane axis 17 is oriented perpendicular to the transition duct axis 9. In this example, $\beta$ be chosen to be equal to a based on standard geometric considerations. The inlet angle of the vane 8 may be designed based on aerodynamic considerations so as to attain maximum possible flow turning in the tangential direction.

Because of the shape of the current design, the transition duct experiences a great deal of radiative heat transfer load. By straightening out the transition duct as illustrated in the embodiment of FIG. 2, the radiative heat transfer load may be reduced significantly as the transition duct 2 is no longer in the direct line of sight of the flame in the combustor 5, but is at an angle. However, this embodiment may lead to added radiative heat transfer load at the first row of stationary vanes 8. In such a case, additional thermal protection may be provided to the first row of stationary vanes 8, for example by way of advanced thermal barrier coatings, ceramic vanes, improved cooling airflow, steam cooling, use high-strength alloys for the vanes, among others.

In an alternate embodiment, the transition duct axis 9 may be a straight line extending from the forward end 10 to the aft end 12 of the transition duct 2, such that the transition duct axis 9 is parallel to the engine axis 6. Accordingly, the vane axis 17 may be aligned along radial direction R. In this case, both $\alpha$ and $\beta$ are equal to zero.

The geometry provided by the illustrated embodiments realizes several significant technical effects. A first technical effect is that pattern factor is no longer a function of the curved transition duct. In other words, the exit thermal profile of the combustor/transition duct unit is much more symmetric and therefore inherently more uniform. A second technical effect is that the because there is no flow turn within the transition duct 2, the transition duct 2 no longer has the hot combustion gas impinging upon it at various locations as exemplified at 16*a*,16*b* in FIG. 1. The formation of hotspots and local thermal stresses is avoided or significantly reduced. The illustrated design requires less secondary cooling on the transition duct wall, whereby engine efficiency is increased. A third technical effect is that because there is no flow turn within the transition duct 2, flow losses are minimized. The illustrated design may also provide potential cost savings from revised duct contours which is relatively simpler to manufacture.

As an added feature, the installation of the combustor/transition duct unit may be simplified by way of the illustrated embodiments because now its attachment to the turbine inlet is a "straight shot" as a consequence of eliminating the turn from inclined to axial direction, as would be the case in the embodiment of FIG. 1. It might therefore be possible to now mount this assembly on a guide structure, such as a rail, which directly guides the unit into position.

An example of an installation tool which may be used for installing the present transition duct is described in the U.S. patent application Ser. No. 14/471,553, filed Aug. 28, 2014 by the present Applicant, which is incorporated herein in its entirety. Briefly, such an installation tool may include a guide structure, such as a pair of rails extending parallel to the intended orientation of the transition duct axis 9. The tool may also include movable connection of the transition duct with the rails. In one embodiment, the movable connection includes a sliding connection, for example, involving a bracket on either side on the outer wall of the transition duct 2, which slidably engages with the rail on the respective side. Other types of movable connections include, for example, rollers or wheels provided on the transition duct 2 that are capable of moving along the rails.

The rails may be initially positioned between the combustor 5 and the stationary vane carrier 14. To this end, the rails may be attached to a combustor component, as a combustor sleeve, at respective connection points on either side. The angle of inclination of the rails with the engine axis 6 corresponds to that of the axis 9 of the transition duct after installation. After the rails are attached in position, the transition duct 2 is engaged with the rails via the movable connection.

Once engaged to the rails, the transition duct 2 is imparted a translation motion along the inclined to move the transition duct 2 towards the installed position. The motion may be imparted manually or by powered devices such as manipulators. As the motion is imparted, the transition duct 2 moves along the inclined rails in a forward-to-aft direction till it directly reaches the final installation position in one "straight shot" translation motion. Once the transition duct 2 is moved to the installation position, the transition aft frame 13 may be securely fastened to the stationary vane carrier 14, for example, by way of retention bolts 33.

Figure 4:
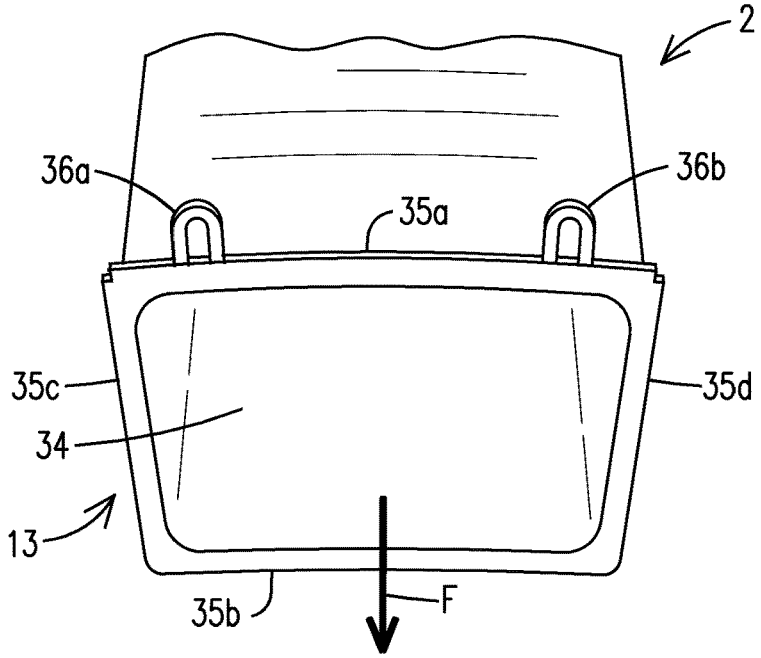
FIG. 4 illustrates a transition aft frame according to one embodiment.

FIG. 4 illustrates an aft end view of a transition aft frame 13 according to one embodiment. The frame 13 comprises a four-sided body that defines a manifold 34 that opens into the turbine section 4. In the illustrated embodiment, the four-sided body of the transition aft frame 13 shape is curved rectilinear in shape, characterized in having side panels 35*c*, 35*d* that oppose one another and being substantially straight. Radially outer and inner panels 35*a*, 35*b* extend between the side panels 35*c*, 35*d* and similarly oppose one another. With respect to the stationary vane carrier 14, the outer and inner panels 35*a*,35*b* are spaced apart in a radial direction, while the side panels 35*c*, 35*d* are spaced apart in a circumferential direction. The outer and inner panels 35*a*, 35*b* exhibit curvatures corresponding to the overall radial curvature of the can-annular configuration.

The transition aft frame 13 is provided with a first attachment point 36*a* and a second attachment point 36*b* on the outer panel 35*a* that engage with corresponding attachment points on the forward face of the stationary vane carrier 14 when the transition duct 2 is moved to the installed position. The first and second attachment points 36*a* and 36*b* are spaced apart in a circumferential direction. The spacing between the attachment points 36*a*, 36*b* is effective to transfer moment load from the first and second attachment points 36*a*, 36*b* to the side panels 35*c*, 35*d* respectively. In one embodiment, the attachment points 36*a*, 36*b* may be disposed directly over the respective side panels 35*c*, 35*d* or at least near the respective side panels 35*c*, 35*d*. In the shown embodiment, the attachment points 36*a*, 36*b* are bolt holes, wherein respective spaced apart bolts 33 (FIG. 2) are used to securely fasten the transition aft frame 13 to the stationary vane carrier 14.

In one embodiment, the illustrated geometry of the transition duct 2, along with the illustrated installation method conveniently allows the transition to be installed with its axis 9 parallel to the engine axis 6. To this end, the axis of combustor 5 may also be parallel to the engine axis 6, thereby providing a completely new combustor design, wherein it is no longer necessary to have an inclined combustor/transition duct unit, thereby providing a simpler manufacture and installation of the combustor/transition duct unit.

In yet another embodiment, the combustor 5 and transition duct 2 may be made as one piece, i.e., monolithically. Such an embodiment eliminates the need for a sealing between the combustor 5 and transition duct 2, thus eliminating air leakage and improving efficiency. The resulting thermal growth can be accounted for upstream of the combustor where the basket attaches to the combustor "top hat".

The illustrated embodiments provide simpler duct contours which simplifies duct construction, duct cooling, installation, and performance. While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

What is claimed is:

1. A can combustor arrangement in a gas turbine engine, comprising: a combustor for producing a working medium by combustion of a mixture of fuel and an oxidant, a turbine section comprising a stationary vane carrier on which a first row of stationary vanes is arranged, and a transition duct for leading the working medium from the combustor to the turbine section, the transition duct having a forward end that adjoins the combustor and an aft end that adjoins the stationary vane carrier, wherein the transition duct has a transition duct axis extending from the forward end to the aft end along a straight line that the working medium is conducted, so that the working medium is conducted through the transition duct to the vane carrier without turbine a flow of the working medium, wherein the transition duct axis is normal to a vane axis of a stationary vane in the first row of stationary vanes, the vane axis being normal to a surface of the vane carrier bounding the flow of the working medium, wherein the transition duct axis is inclined at a non-zero angle with respect to a symmetrical engine axis of the gas turbine engine, wherein the stationary vane is arranged on the stationary vane carrier such that the vane axis is inclined at the same angle as the transition duct axis with respect to a radial direction whereby the transition duct axis is normal to the vane axis, and the radial direction is normal to the engine axis of the gas turbine engine.

2. The arrangement according to claim 1, wherein the transition duct defines a conduit for the working medium, wherein the conduit transitions from a generally circular cross-section at the forward end to a curved rectilinear cross-section at the aft end.

3. The arrangement according to claim 1, wherein the transition duct comprises a transition aft frame at the aft end, and wherein the transition aft frame is fastened to a forward face of the stationary vane carrier.

4. The arrangement according to claim 3, wherein the transition aft frame is fastened to the forward face of the stationary vane carrier by way of at least one retention bolt.

5. The arrangement according to claim 4, wherein the transition aft frame has a curved rectilinear shape, comprising a radially outer panel, a radially inner panel and a pair of side panels connecting the radially outer panel and the radially inner panel, and wherein the at least one retention bolt comprises first and second retention bolts arranged spaced apart on the radially outer panel, the spacing being effective to transfer moment load from the first and second retention bolts to the pair of side panels respectively.

6. The arrangement according to claim 1, wherein the transition duct is formed monolithically in one piece with the combustor.

7. A method for installing a transition duct in a gas turbine engine, comprising: positioning the transition duct between a combustor and a turbine section of the gas turbine engine, the combustor configured to produce a working medium by combustion of a mixture of fuel and an oxidant, the turbine section comprising a stationary vane carrier on which a first row of stationary vanes is arranged, wherein a forward end of the transition duct adjoins the combustor and an aft end of the transition duct adjoins the stationary vane carrier, the transition duct is configured for leading the working medium from the combustor to the turbine section, wherein the transition duct has a transition duct axis extending from the forward end to the aft end along a straight line that the working medium is conducted so that the working medium is conducted through the transition duct to the vane carrier without turning a flow of the working medium, wherein the transition duct axis is normal to a vane axis of a stationary vane in the first row of stationary vanes, the vane axis being normal to a surface of the vane carrier bounding the flow of the working medium, wherein the transition duct axis is inclined at a non-zero angle with respect to a symmetrical engine axis of the gas turbine engine, wherein the stationary vane is arranged on the stationary vane carrier such that the vane axis is inclined at the same angle as the transition duct axis with respect to a radial direction whereby the transition duct axis is normal to the vane axis, and the radial direction is normal to the engine axis of the gas turbine engine.

8. The method according to claim 7, wherein the positioning of the transition duct comprises:

positioning a guide structure extending along a longitudinal direction, wherein at least a portion of the guide structure is disposed between the turbine section and the combustor, engaging the transition duct with the guide structure such that the transition duct is movable along the guide structure, whereby the transition duct axis is aligned with the longitudinal direction of the guide structure, and imparting a translation motion to the transition duct along the guide structure in a forward-to-aft direction, to move the transition duct along the straight line until the transition duct engages with a forward face of the stationary vane carrier.

9. The method according to claim 8, wherein the guide structure comprises a track or a rail.

10. The method according to claim 8, wherein the transition duct is engaged slidably to the guide structure.

11. The method according to claim 8, wherein the guide structure comprises a pair of rails or tracks that are positioned by attaching said pair of rails or tracks to diametrically opposite sides of the combustor.

* * * * *